US008814760B2

(12) United States Patent
Hyacinth

(10) Patent No.: US 8,814,760 B2
(45) Date of Patent: Aug. 26, 2014

(54) FITNESS SYSTEM AND METHOD FOR ALIGNMENT OF LOWER EXTREMITIES

(76) Inventor: Flora Hyacinth, San Diego, CA (US)

( * ) Notice: Subject to any disclaimer, the term of this patent is extended or adjusted under 35 U.S.C. 154(b) by 856 days.

(21) Appl. No.: 12/975,141

(22) Filed: Dec. 21, 2010

(65) Prior Publication Data

US 2012/0004079 A1 Jan. 5, 2012

Related U.S. Application Data

(60) Provisional application No. 61/288,470, filed on Dec. 21, 2009.

(51) Int. Cl.
*A63B 21/00* (2006.01)

(52) U.S. Cl.
USPC ..... 482/92; 482/122; 602/24

(58) Field of Classification Search
USPC ..... 482/92, 122; 602/24; 5/648, 650; 128/882
See application file for complete search history.

(56) References Cited

U.S. PATENT DOCUMENTS

| | | | | | |
|---|---|---|---|---|---|
| 4,135,504 | A * | 1/1979 | Spann | 602/24 |
| 4,327,714 | A * | 5/1982 | Spann | 602/24 |
| 4,372,299 | A * | 2/1983 | Fixel | 602/24 |
| 4,392,489 | A * | 7/1983 | Wagner, Sr. | 602/24 |
| D349,541 | S * | 8/1994 | Bertolucci et al. | D21/686 |
| 7,223,217 | B1 * | 5/2007 | Liao | 482/122 |
| 2002/0092098 | A1 * | 7/2002 | Michalow | 5/648 |
| 2009/0229056 | A1 * | 9/2009 | Edinger | 5/648 |
| 2010/0274166 | A1 | 10/2010 | Terrio | |

* cited by examiner

*Primary Examiner* — Glenn Richman
(74) *Attorney, Agent, or Firm* — Lewis Kohn & Fitzwilliam LLP; Timothy W. Fitzwilliam

(57) ABSTRACT

A lower extremity alignment device for maintaining proper form while engaging in squat or other weight lifting exercises is disclosed. More specifically, a user's knee joints will resist rotating inward or outward during repetitions due to support provided by the device while core muscled benefits are still realized. In a first preferred embodiment, the device is optimally shaped with a tapered end to provide comfort to the user's groin area. Additionally, the device comprises a softer inner core and a more rigid outer core also aiding in comfort to a user. The invention further provides grip material to lateral side portions so the device will not slip when in use, as well as other novel features as described herein.

15 Claims, 5 Drawing Sheets

FITNESS SYSTEM AND METHOD FOR ALIGNMENT OF LOWER EXTREMITIES

PRIORITY CLAIM

This patent application contains subject matter claiming benefit of the priority date of U.S. Prov. Pat. App. Ser. No. 61/288,470 filed on Dec. 21, 2009 entitled SYSTEM AND METHOD FOR ALIGNMENT OF LOWER EXTREMITIES, accordingly, the entire contents of this patent application is hereby expressly incorporated by reference.

BACKGROUND OF THE INVENTION

1. Field of the Invention

The present invention pertains generally to exercise methods targeting lower muscles including the hips, thighs and buttocks, and other exercises requiring lower body stabilization such as cleans and deadlifts. More particularly, the invention pertains to devices and methods for maintaining proper alignment of lower extremities during strength training. In a preferred embodiment, the invention is more specifically useful as a fitness device and method for maintaining alignment of the knees and pelvis during squat exercises or similar weightlifting activity.

2. Description of the Prior Art

Many weightlifting and fitness experts agree that properly performed squat exercises are the most effective way to build mass and strength to the legs and gluteal muscles. An even greater concurrence among experts is that incorrect squatting techniques can lead to severe discomfort or injury to the spine, lower back and knee joints. Same true for cleans and deadlifts.

One such improper technique is a weightlifter leaning forward which can be corrected by use of a Smith machine that will constrict the barbell to substantially movement only in the vertical plane. However, critics of the Smith machine point out that it does not effectively develop stabilization muscles as compared to using free weights. Another device that provides support and stabilization to the lower back area during heavy lifting is a simple weight belt. However surprisingly, the present state of the art lacks many other devices assisting in proper stabilization, alignment and technique during squatting exercises.

An additional problem encountered is a frequent tendency to rotate the knees in or out during a repetition. Misalignment of the knees inward will cause medial (MCL) knee pain while a misalignment outward will result in unwanted pressure to the lateral or outside knee ligaments. Still further, the pelvis of a weightlifter, or anyone lifting weights, may become misaligned during particularly heavy lifting.

In light of the above, it is an object of the present invention to provide a weightlifting apparatus and method that provides proper alignment and stabilization to the lower extremities during squatting or similar exercises such as the a leg press. It is more particularly an object of the present invention provide proper alignment to the knees and pelvis limiting undesirable ligament or lower back pressure. It is further an object of the present invention to provide a weightlifting device that allows the user to lift more weight without overly limiting the advantages of free weights versus a constrained weight system. It is an additional object of the present invention to provide an alignment device that is adjustable to a particular user's stance during a squat exercise.

BRIEF SUMMARY OF THE INVENTION

The present invention specifically addresses and alleviates the above mentioned deficiencies associated with the prior art. More particularly, the present invention comprises an exercise device for maintaining lower body alignment during an exercise repetition comprising: an upper portion; a lower portion opposite the upper portion; a left and a right lateral side portion for mating to a user's thighs; a left adjustable strap coupled to the left lateral side portion for securing the left lateral side portion to a user's left thigh, wherein the device aids the user in maintaining proper alignment to the user's knees and pelvis during an exercise repetition.

The exercise device is additionally characterized as comprising a right adjustable strap coupled to the right lateral side portion for securing the right lateral side portion to a user's right thigh, wherein the left and right lateral side portions comprise a concave surface for mating to the user's left and right thigh. Also according to a preferred embodiment, first and second concave surfaces are provided to each side for maintaining secure placement to the user's thighs.

The exercise device is additionally characterized in that is has a forward surface and a tapered end surface, the tapered end facing a user's groin area during use for increased comfort to the user. Also in the first preferred embodiment, a first curved surface connects the upper portion to the tapered end surface. Additionally a skin material encases the device and a Velcro seam is provided in the skin material. In a preferred embodiment, the skin material is comprised of lycra or neoprene.

The exercise device is additionally characterized as comprising an inner core; and an outer core substantially surrounding the inner core, the inner core and outer core each having a rigidity, and wherein the inner core and outer core have a different rigidity with respect to each other providing maximum comfort to the user. Also, an access hole in the outer core is provided to access the inner core, for optionally providing a change in inner core material as chosen by the user. Yet further, grip material is provided to the left and right lateral sides for secure mating to the user's thighs. Still further, a curved surface connects the upper portion to the tapered end portion.

In a second aspect, the invention may be characterized as an exercise device for maintaining lower body alignment during an exercise repetition comprising: an upper portion; a lower portion opposite the upper portion; a left and a right lateral side portion for mating to a user's thighs; a forward surface; and a tapered end surface, the tapered end facing a user's groin area during use for increased comfort to the user.

The invention in this aspect is additionally characterized as comprising a right adjustable strap coupled to the right lateral side portion for securing the right lateral side portion to a user's right thigh; and a left adjustable strap coupled to the left lateral side portion for securing the left lateral side portion to a user's left thigh. Also the invention is characterized wherein the device aids the user in maintaining proper alignment to the user's knees and pelvis during an exercise repetition, wherein the left and right lateral side portions comprise a concave surface for mating to the user's left and right thigh.

Still further, the invention in this aspect is characterized in that it comprises a skin material encasing the device and wherein the forward surface comprises a Velcro seam in the skin material; and grip material to the skin material at the left and right lateral sides. As before, this embodiment includes an inner core; and an outer core substantially surrounding the inner core, the inner core and outer core each having a rigidity, and wherein outer core rigidity is less than the inner core rigidity providing maximum comfort to a user.

In yet another aspect, the invention may be characterized as an exercise device for maintaining lower body alignment during an exercise repetition comprising: an upper portion; a lower portion opposite the upper portion; a left and a right lateral side portion for mating to a user's thighs; a forward surface connecting the upper portion and the lower portion; an end surface opposite the forward surface, the end facing a user's groin area during use; a right adjustable strap coupled to the right lateral side portion for securing the right lateral side portion to a user's right thigh; and a left adjustable strap coupled to the left lateral side portion for securing the left lateral side portion to a user's left thigh, wherein the device aids the user in maintaining proper alignment to the user's knees and pelvis during an exercise repetition, wherein the left and right lateral side portions comprise a concave surface for mating to the user's left and right thigh.

The invention in this aspect is additionally characterized in that it includes a skin material encasing the device and wherein the forward surface comprises a Velcro seam in the skin material; and grip material to the skin material at the left and right lateral sides. Importantly, in this embodiment, the exercise device comprises an inner core; and an outer core substantially surrounding the inner core, wherein the inner core comprises pressurized air greater than atmosphere and the outer core comprises relatively soft polyurethane foam material providing maximum comfort to a user. It should be readily understood and recognized that novel methods of performing exercises using devices of the present invention are disclosed herein to include performing squats, cleans, and deadlifts.

These, as well as other advantages of the present invention will be more apparent from the following description and drawings wherein like elements are referenced by like numerals. It is understood that changes in the specific structure shown and described may be made within the scope of the claims, without departing from the spirit of the invention.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF THE PREFERRED EMBODIMENTS

Figure 1A:
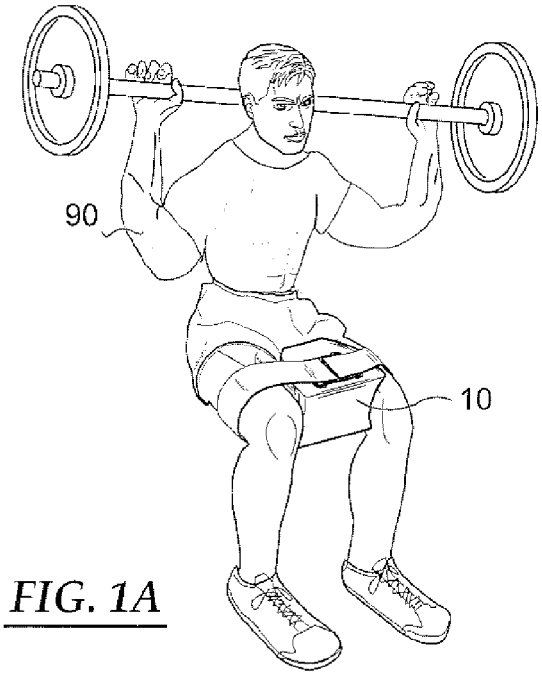
FIG. 1A is a perspective illustration of a first preferred embodiment of the present invention as may be employed by a user.
Figure 1B:
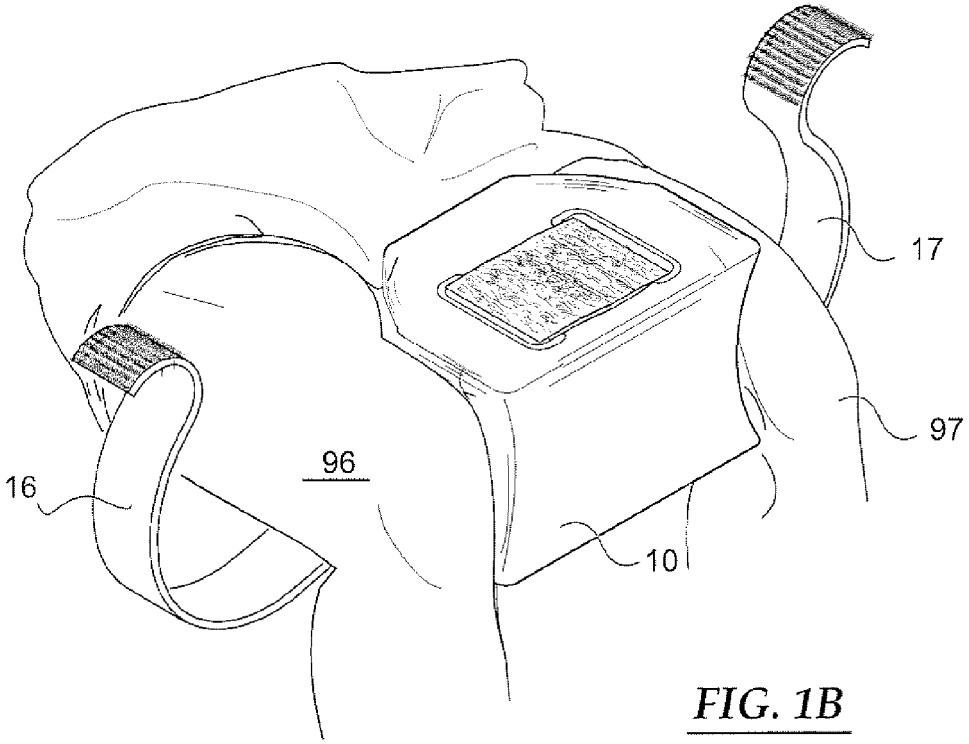
FIG. 1B illustrates an enlarged view thereof.
Figure 2A:
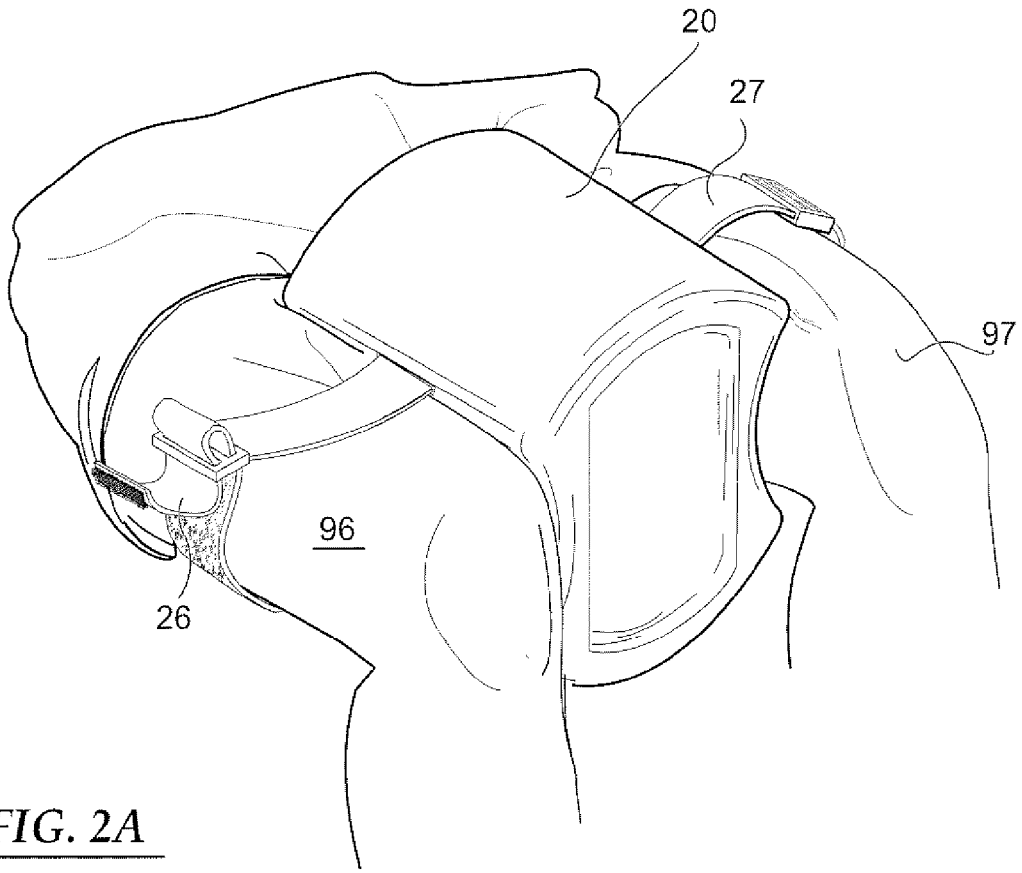
FIG. 2A is an enlarged perspective view of a second invention embodiment.
Figure 2B:
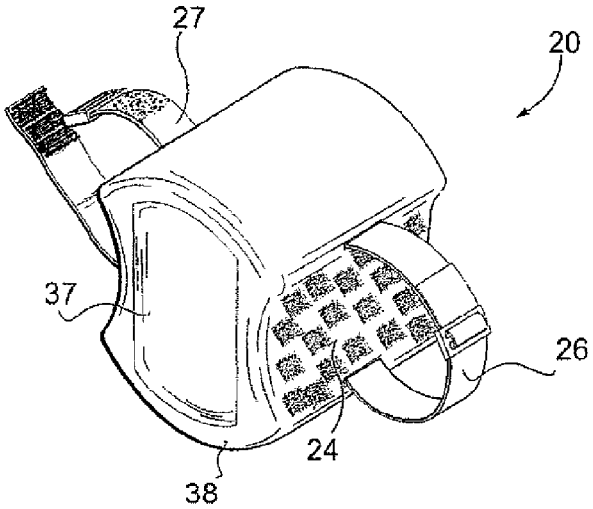
FIG. 2B is an additional perspective view thereof.
Figure 2C:
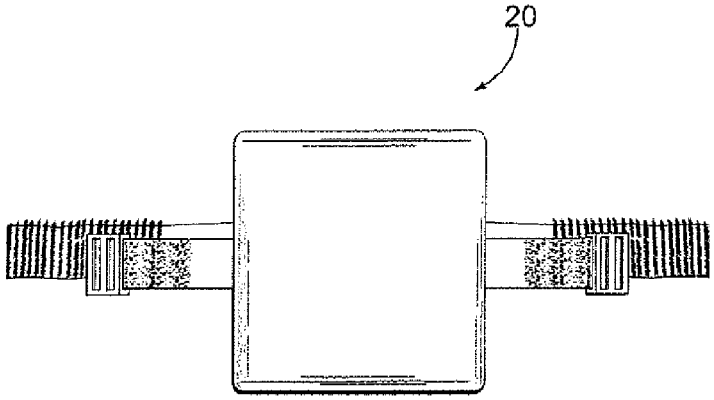
FIG. 2C is a top plan view of the second invention embodiment.
Figure 2D:
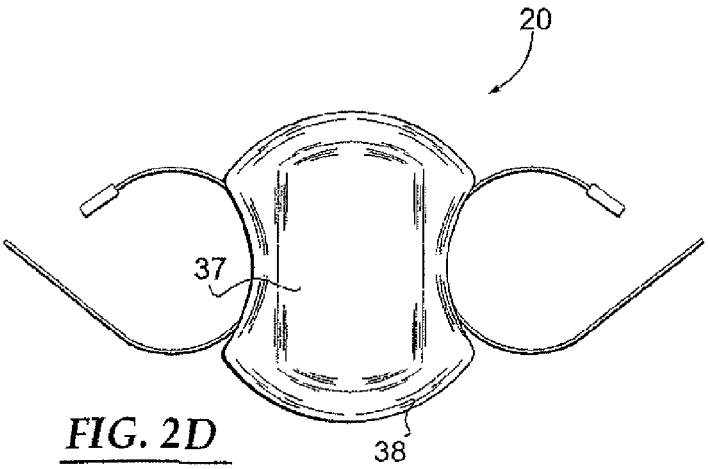
FIG. 2D is a front plan view of this embodiment.

Initially, with reference to FIG. 1A, a preferred device 10 of the present invention is illustrative in perspective as a user 90 performs an exercise. This particular design 10 will provide comfort and stability as further shown and described herein. FIG. 1B (FIG. 2A) provides an enlarged view thereof 10, 20 with right 16, 26 and left 17, 27 adjustable straps coupled to a user's right 96 and left 97 thigh. As tension in the user's quadriceps 96, 97 stabilizes the lower extremities, the user's knees and pelvis remain aligned and parallel during a repetition. Comparatively, weights will feel lighter while using the device 10, 20 thereby allowing a user 90 to squat lower or use more weight. As stated herein, without the use of the present invention 10, 20 knees will typically rotate inward when the weight becomes relatively heavy.

Among the benefits of the present invention 10, 20 is that it is not overly restrictive as to cause a user 90 to lose the benefits of free weights. That is, some exercise devices and machines will greatly reduce the stabilizing muscles (such as core muscles) required to perform a repetition. Presently herein, this is not the case since the quadriceps 96, 97 are still stabilizing the body as well as the normal benefits to the thighs, hips and buttocks. The invention 10, 20 may also be particularly applicable to rehabilitation applications where an injured athlete is trying to regain strength without causing harm to joints and ligaments. It is further contemplated that the invention 10, 20 is likewise applicable to rehabilitation applications that are not sports related. Still further, the invention 10, 20 could be employed to water exercise applications.

Figure 1C:
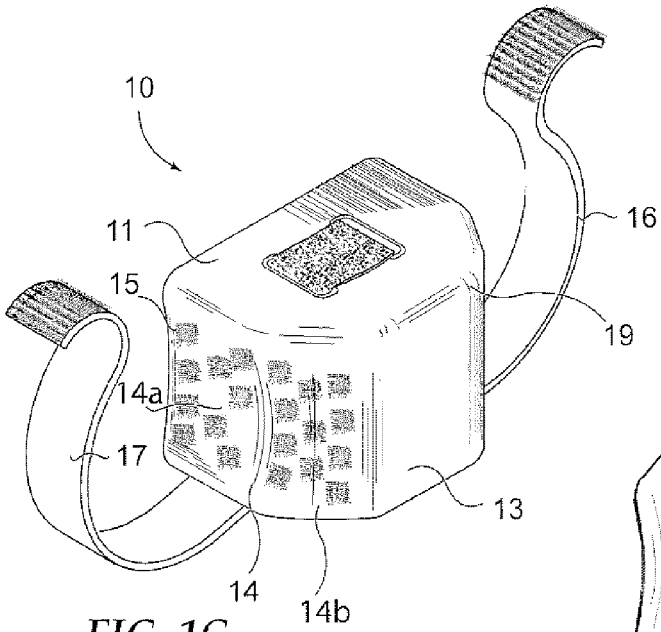
FIG. 1C is an additional perspective view from a rear vantage point.

With regard to FIG. 1C, a more detailed perspective view is provided from a rear vantage point. As shown, the invention 10, 20 has: an upper portion 11; a lower portion 12 opposite the upper portion 11; a left 14 and a right lateral side portion for mating to a user's thighs 26, 27. The invention additionally provides straps 16, 26, 17, 27 to aid in the mating to a user's thighs 96, 97. In the present example 10 (FIG. 1C), D-rings are provided to the upper portion 11 to aid in securing straps 16, 17.

Figure 1D:
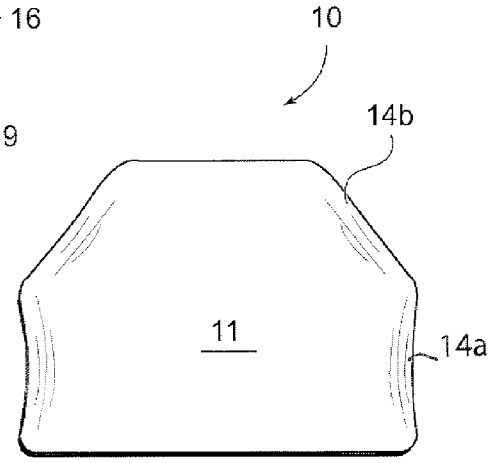
FIG. 1D is a top plan view of the device illustrating its shape in a top aspect.

Importantly the device has a concave surface 14, 24 for mating to the user's left 97 and right 96 thigh. In an additional preferred embodiment, the invention provides two such concave surfaces 14*a*, 14*b* to each side (left side 14 as shown) as further illustrated in FIG. 1D.

Figure 1E:
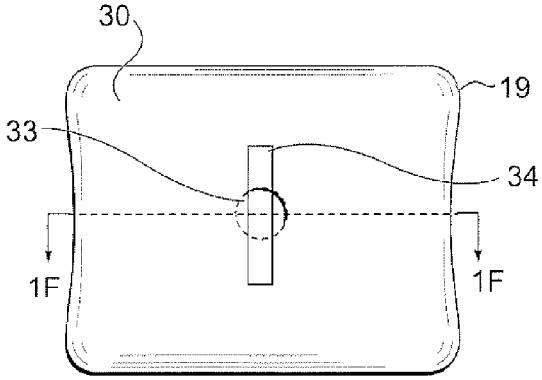
FIG. 1E further illustrate a front plan view of the present invention.

Now with reference to FIG. 1E together with FIG. 1C, the exercise device 10 additionally has a forward surface 30 and a tapered end surface 13, the tapered end 13 facing a user's 90 groin area during use for increased comfort to the user 90. Also in the first preferred embodiment 10, a first curved surface 19 connects the upper portion 11 to the tapered end surface 13. Other curved surfaces 19 are illustrated in FIG. 1E. Additionally a skin material 18 encases the device 10 and a Velcro seam 33 is provided in the skin material 18 as further described herein.

Figure 1F:
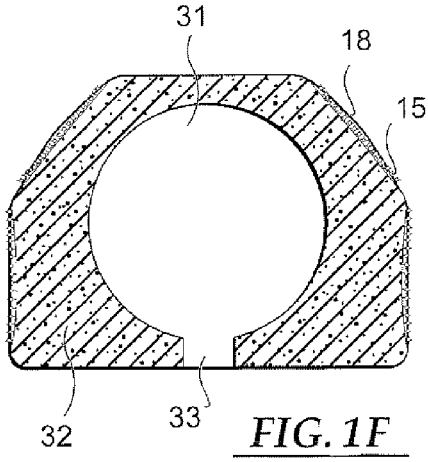
FIG. 1F is a cross-section view of the first preferred embodiment taken along line 1F-1F in FIG. 1E.
Figure 1G:
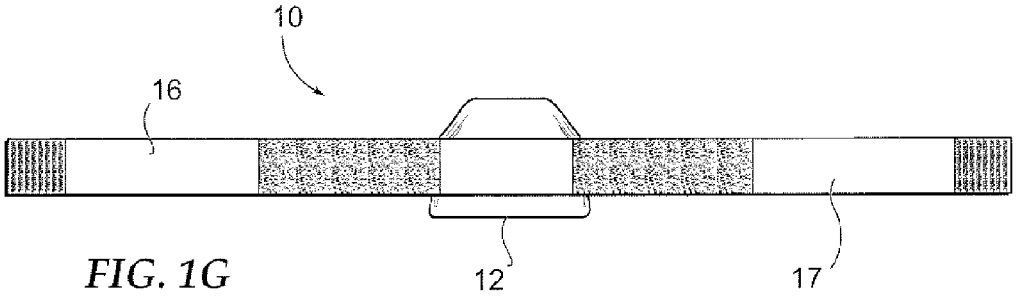
FIG. 1G is a bottom plan view of the present invention illustrating adjustable straps of the present invention coupled thereto.
Figure 1H:
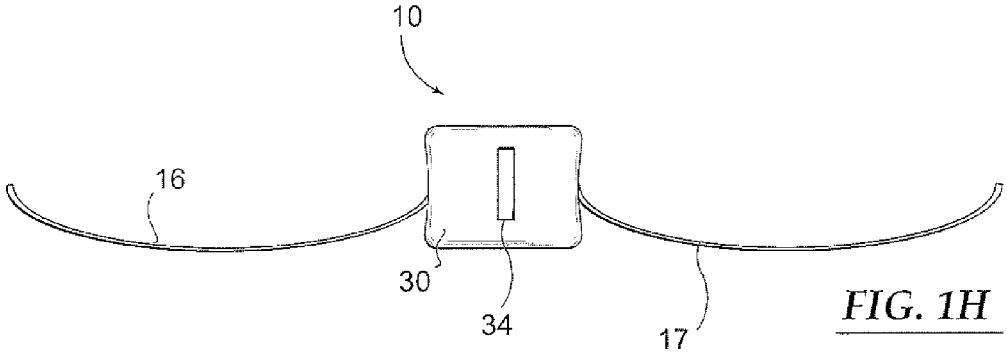
FIG. 1H is an additional front plan view.
Figure 1I:
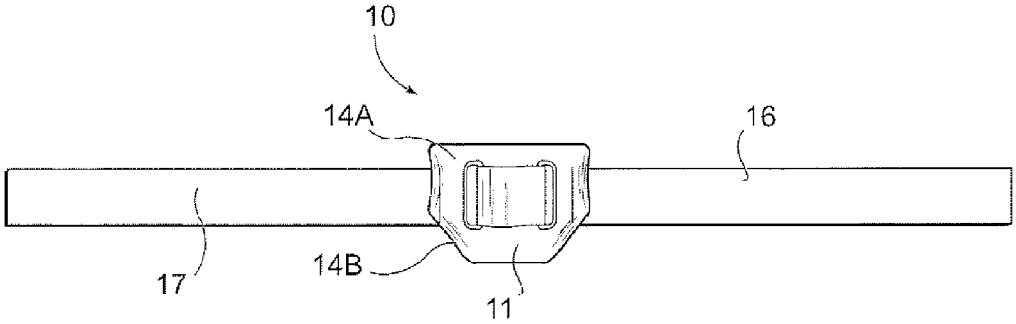
FIG. 1I is a top plan view of the first invention embodiment.

In a preferred embodiment 10 as illustrated in sectional view FIG. 1F, an inner core 31 has different material, typically more rigid than outer core 32 which is comprised of relatively soft polyurethane foam for maximum comfort without sacrificing stability. Hole 33 along with seam 34 provides access to the inner core 31 to provide interchangeability of material to the inner core 31. In a preferred embodiment, hole 33 could be configured with a valve so that pressurized air could be provided to the inner core 31. In this 10 and other embodiments 20, outer core 32, 38 substantially surrounds the inner core 31, 37. Yet further, grip material 15 is provided to the left 14, 24 and right lateral sides for secure mating to the user's thighs 96, 97.

The invention 10, 20 additionally provides a left adjustable strap 17, 27 coupled to the left lateral side portion 14, 24 for securing the device 10, 20, and similarly on the right side. The straps 16, 17, 26, 27 may optionally comprise Velcro, or hook and loop fasteners to secure excess strap length.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

While the particular Fitness System and Method for Alignment of Lower Extremities as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. An exercise device for maintaining lower body alignment during an exercise repetition comprising:

an upper portion;

a lower portion opposite the upper portion;

a left and a right lateral side portion for mating to a user's thighs;

a left adjustable strap coupled to the left lateral side portion for securing the left lateral side portion to a user's left thigh, wherein the device aids the user in maintaining proper alignment to the user's knees and pelvis during an exercise repetition;

an inner core; and an outer core substantially surrounding the inner core, the inner core and outer core each having a rigidity, and wherein the inner core and outer core have a different rigidity with respect to each other providing maximum comfort to the user.

2. The exercise device of claim 1, further comprising a right adjustable strap coupled to the right lateral side portion for securing the right lateral side portion to a user's right thigh, wherein the left and right lateral side portions comprise a concave surface for mating to the user's left and right thigh.

3. The exercise device of claim 2 wherein the concave surface is a first concave surface and wherein each of left and right lateral sides each comprise first and second concave surfaces for enhanced mating to a user's thigh.

4. The exercise device of claim 1, further comprising:

a forward surface; and a tapered end surface, the tapered end facing a user's groin area during use for increased comfort to the user.

5. The exercise device of claim 4, further comprising:

a first curved surface connecting the upper portion to the tapered end surface; and a skin material encasing the device and wherein the forward surface comprises a Velcro seam in the skin material.

6. The exercise device of claim 1, further comprising an access hole in the outer core providing access to the inner core, for optionally providing a change in inner core material as chosen by the user.

7. The exercise device of claim 1, the left and right lateral sides further comprising grip material for secure mating to the user's thighs.

8. The exercise device of claim 1, further comprising first curved surface connecting the upper portion to the tapered end portion.

9. An exercise device for maintaining lower body alignment during an exercise repetition comprising:

an upper portion;

a lower portion opposite the upper portion;

a left and a right lateral side portion for mating to a user's thighs;

a forward surface;

a tapered end surface, the tapered end facing a user's groin area during use for increased comfort to the user;

an inner core; and an outer core substantially surrounding the inner core, the inner core and outer core each having a rigidity, and wherein outer core rigidity is less than the inner core rigidity providing maximum comfort to a user.

10. The exercise device of claim 9, further comprising:

a right adjustable strap coupled to the right lateral side portion for securing the right lateral side portion to a user's right thigh; and a left adjustable strap coupled to the left lateral side portion for securing the left lateral side portion to a user's left thigh, wherein the device aids the user in maintaining proper alignment to the user's knees and pelvis during an exercise repetition, wherein the left and right lateral side portions comprise a concave surface for mating to the user's left and right thigh.

11. The exercise device of claim 10, wherein the concave surface is a first concave surface and wherein each of left and right lateral sides each comprise first and second concave surfaces for enhanced mating to a user's thigh.

12. The exercise device of claim 9, further comprising:

a skin material encasing the device and wherein the forward surface comprises a Velcro seam in the skin material; and grip material to the skin material at the left and right lateral sides.

13. The exercise device of claim 9, further comprising first curved surface connecting the upper portion to the tapered end portion.

14. An exercise device for maintaining lower body alignment during an exercise repetition comprising:

an upper portion;

a lower portion opposite the upper portion;

a left and a right lateral side portion for mating to a user's thighs;

a forward surface connecting the upper portion and the lower portion;

an end surface opposite the forward surface, the end facing a user's groin area during use;

a right adjustable strap coupled to the right lateral side portion for securing the right lateral side portion to a user's right thigh;

a left adjustable strap coupled to the left lateral side portion for securing the left lateral side portion to a user's left thigh, wherein the device aids the user in maintaining proper alignment to the user's knees and pelvis during an exercise repetition, wherein the left and right lateral side portions comprise a concave surface for mating to the user's left and right thigh;

an inner core; and an outer core substantially surrounding the inner core, wherein the inner core comprises pressurized air greater than atmosphere and the outer core comprise relatively soft polyurethane foam material providing maximum comfort to a user.

15. The exercise device of claim 14, further comprising:

a skin material encasing the device and wherein the forward surface comprises a Velcro seam in the skin material; and grip material to the skin material at the left and right lateral sides.

* * * * *